US009598743B2

(12) United States Patent
Fushiwaki et al.

(10) Patent No.: US 9,598,743 B2
(45) **Date of Patent: *Mar. 21, 2017**

(54) HIGH STRENGTH STEEL SHEET AND METHOD FOR MANUFACTURING THE SAME

(75) Inventors: Yusuke Fushiwaki, Fukuyama (JP); Yoshitsugu Suzuki, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/821,637

(22) PCT Filed: Sep. 22, 2011

(86) PCT No.: PCT/JP2011/072491

§ 371 (c)(1),
(2), (4) Date: Mar. 8, 2013

(87) PCT Pub. No.: WO2012/043776

PCT Pub. Date: Apr. 5, 2012

(65) Prior Publication Data

US 2013/0174946 A1 Jul. 11, 2013

(30) Foreign Application Priority Data

Sep. 29, 2010 (JP) ..... 2010-218397

(51) Int. Cl.

| | |
|---|---|
| ***C21D 8/02*** | (2006.01) |
| ***C22C 38/16*** | (2006.01) |
| ***C22C 38/14*** | (2006.01) |
| ***C22C 38/02*** | (2006.01) |
| ***C22C 38/08*** | (2006.01) |
| ***C22C 38/06*** | (2006.01) |
| ***C22C 38/04*** | (2006.01) |
| ***C22C 38/12*** | (2006.01) |
| ***C22C 38/38*** | (2006.01) |
| ***C21D 1/72*** | (2006.01) |
| ***C21D 1/74*** | (2006.01) |
| ***C21D 6/00*** | (2006.01) |
| ***C25D 5/36*** | (2006.01) |
| ***C25F 1/04*** | (2006.01) |

(52) U.S. Cl.

CPC ..... *C21D 8/0247* (2013.01); *C21D 1/72* (2013.01); *C21D 1/74* (2013.01); *C21D 6/008* (2013.01); *C21D 8/0278* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/38* (2013.01); *C25D 5/36* (2013.01); *C25F 1/04* (2013.01)

(58) Field of Classification Search

CPC ..... C22C 38/00; C22C 38/02; C22C 38/04; C22C 38/06; C22C 38/08; C22C 38/12; C22C 38/14; C22C 38/16; C22C 38/38; C21D 1/72; C21D 1/74; C21D 6/008; C21D 8/0247; C21D 8/0278; C25D 5/36; C25F 1/04

USPC ..... 148/320, 337, 579, 621

See application file for complete search history.

(56) References Cited

U.S. PATENT DOCUMENTS

| | | | | |
|---|---|---|---|---|
| 6,063,451 | A * | 5/2000 | Murata | B05D 1/06 361/227 |
| 8,241,557 | B2 * | 8/2012 | Sugiyama et al. | 419/35 |
| 2003/0047255 | A1 * | 3/2003 | Delaunay | C23C 2/02 148/579 |
| 2004/0234807 | A1 | 11/2004 | Suzuki | |
| 2005/0139293 | A1 * | 6/2005 | Nomura et al. | 148/320 |
| 2009/0053096 | A1 * | 2/2009 | Miura et al. | 420/103 |
| 2009/0123651 | A1 * | 5/2009 | Okada | 427/319 |
| 2009/0308498 | A1 * | 12/2009 | Matsumura et al. | 148/284 |
| 2013/0174946 | A1 | 7/2013 | Fushiwaki | |
| 2013/0306203 | A1 | 11/2013 | Fushiwaki | |

FOREIGN PATENT DOCUMENTS

| | | |
|---|---|---|
| CA | 2810989 | 4/2012 |
| EP | 1482066 | 12/2004 |
| EP | 1548142 | 6/2005 |
| EP | 1865085 | 12/2007 |
| EP | 2103715 | 9/2009 |

(Continued)

OTHER PUBLICATIONS

International Search Report for International Application No. PCT/JP2011/072491 mailed Jan. 17, 2012.

U.S. Office Action mailed Sep. 10, 2015 in U.S. Appl. No. 13/822,153.

U.S. Office Action mailed Sep. 4, 2015 in U.S. Appl. No. 13/822,832.

U.S. Notice of Allowance for U.S. Appl. No. 13/822,832, dated Sep. 8, 2016, 16 pages.

Korean Office Action dated Jun. 27, 2016 for Korean Application No. 2015-7030335, including Concise Statement of Relevance, 16 pages.

Entire patent prosecution history of U.S. Appl. No. 13/822,153, filed May 21, 2013, entitled, "High Strength Steel Sheet and Method for Manufacturing the Same."

(Continued)

*Primary Examiner* — Jessee Roe
*Assistant Examiner* — Jenny Wu
(74) *Attorney, Agent, or Firm* — RatnerPrestia

(57) ABSTRACT

A method for manufacturing such steel sheet includes continuous annealing of a steel sheet which includes, in terms of mass %, C at 0.01 to 0.18%, Si at 0.4 to 2.0%, Mn at 1.0 to 3.0%, Al at 0.001 to 1.0%, P at 0.005 to 0.060% and S at ≤0.01%, the balance being represented by Fe and inevitable impurities, in such a manner that the dew point of the atmosphere is controlled to become not more than −45° C. during the course of soaking when the annealing furnace inside temperature is in the range of not less than 820° C. and not more than 1000° C. as well as that the dew point of the atmosphere is controlled to become not more than −45° C. during the course of cooling when the annealing furnace inside temperature is in the range of not less than 750° C.

12 Claims, No Drawings

(56) References Cited

FOREIGN PATENT DOCUMENTS

| | | |
|---|---|---|
| EP | 2381004 | 10/2011 |
| EP | 2518181 | 10/2012 |
| EP | 2623618 | 8/2013 |
| EP | 2623630 | 8/2013 |
| JP | 55-145122 | 11/1980 |
| JP | 62-7890 | 1/1987 |
| JP | 5-320952 | 12/1993 |
| JP | 6-10096 | 1/1994 |
| JP | 7-157891 | 6/1995 |
| JP | 07316762 | 12/1995 |
| JP | 09019775 | 1/1997 |
| JP | 10110300 | 4/1998 |
| JP | 2003-113441 | 4/2003 |
| JP | 2004-323969 | 11/2004 |
| JP | 2006-045615 | 2/2006 |
| JP | 2006097094 | 4/2006 |
| JP | 2006-283130 | 10/2006 |
| JP | 2006-283131 | 10/2006 |
| JP | 2008-156734 | 7/2008 |
| JP | 2009263752 | 11/2009 |
| JP | 2010-53446 | 3/2010 |
| JP | 2010053371 | 3/2010 |
| JP | 2010-126757 | 6/2010 |
| JP | 2010126758 | 6/2010 |
| JP | 2010-255106 | 11/2010 |
| JP | 5609494 | 10/2014 |
| KR | 1020090119264 | 11/2009 |
| WO | 2007043273 | 4/2007 |
| WO | 2010061954 | 6/2010 |
| WO | 2012042676 | 4/2012 |
| WO | 2012043776 | 4/2012 |

OTHER PUBLICATIONS

Entire patent prosecution history of U.S. Appl. No. 13/822,832, filed May 29, 2013, entitled, "High Strength Steel Sheet and Method for Manufacturing the Same."

International Search Report dated Nov. 22, 2010, application No. PCT/JP2010/067611.

International Search Report dated Nov. 22, 2010, application No. PCT/JP2010/067612.

Canadian Office Action dated Feb. 18, 2016 for Canadian Application No. 2,810,989.

U.S. Office Action mailed Feb. 26, 2016 in U.S. Appl. No. 13/822,832.

Final Office Action for U.S. Appl. No. 13/822,153, dated May 26, 2016.

Extended European Search Report for EP Application No. 10857889.9, dated Oct. 20, 2016, 8 pages.

* cited by examiner

HIGH STRENGTH STEEL SHEET AND METHOD FOR MANUFACTURING THE SAME

CROSS REFERENCE TO RELATED APPLICATIONS

This application is the U.S. National Phase application of PCT International Application No. PCT/JP2011/072491, filed Sep. 22, 2011, and claims priority to Japanese Patent Application No. 2010-218397, filed Sep. 29, 2010, the disclosure of both applications are incorporated herein by reference in their entireties for all purposes.

FIELD OF INVENTION

The present invention relates to a high strength steel sheet having excellent phosphatability and corrosion resistance after electro-coating even in the case where the steel sheet has a high Si content, as well as to a method for manufacturing such steel sheets.

BACKGROUND OF THE INVENTION

From the viewpoint of the improvements in automobile fuel efficiency and crash safety of the automobiles, there have recently been increasing demands for car body materials to be increased in strength for thickness reduction in order to reduce the weight and increase the strength of car bodies themselves. For this purpose, the use of high strength steel sheets in automobiles has been promoted.

In general, automotive steel sheets are painted before use. As a pretreatment before painting, a conversion treatment called phosphatization is performed. The conversion treatment for steel sheets is one of the important treatments for ensuring corrosion resistance after painting.

The addition of silicon is effective for increasing the strength and the elongation of steel sheets. During continuous annealing, however, silicon is oxidized even if the annealing is performed in a reductive $N_2$+$H_2$ gas atmosphere which does not induce the oxidation of Fe (which reduces Fe oxides). As a result, a silicon oxide ($SiO_2$) is formed on the outermost surface of a steel sheet. This $SiO_2$ inhibits a reaction for forming a chemical film during a conversion treatment, thereby resulting in a microscopical region where any chemical film is not generated. (Hereinafter, such a region will be sometimes referred to as "non-covered region"). That is, phosphatability is lowered.

Among conventional techniques directed to the improvement of phosphatability of high-Si steel sheets, Patent Literature 1 discloses a method in which an iron coating layer is electroplated at 20 to 1,500 mg/m$^2$ onto a steel sheet. However, this method entails the provision of a separate electroplating facility and increases costs correspondingly to an increase in the number of steps.

Further, Patent Literatures 2 and 3 provide an improvement in phosphatability by specifying the Mn/Si ratio and by adding nickel, respectively. However, the effects are dependent on the Si content in a steel sheet, and a further improvement will be necessary for steel sheets having a high Si content.

Patent Literature 4 discloses a method in which the dew point during annealing is controlled to be −25 to 0° C. so as to form an internal oxide layer which includes a Si-containing oxide within a depth of 1 μm from the surface of a steel sheet base as well as to control the proportion of the Si-containing oxide to be not more than 80% over a length of 10 μm of the surface of the steel sheet. However, the method described in Patent Literature 4 is predicated on the idea that the dew point is controlled with respect to the entire area inside a furnace. Thus, difficulties are encountered in controlling the dew point and ensuring stable operation. If annealing is performed while the controlling of the dew point is unstable, the distribution of internal oxides formed in a steel sheet becomes nonuniform to cause a risk that phosphatability may be variable in a longitudinal direction or a width direction of the steel sheet (non-covered regions may be formed in the entirety or a portion of the steel sheet). Even though an improvement in phosphatability is attained, a problem still remains in that corrosion resistance after electro-coating is poor because of the presence of the Si-containing oxide immediately under the chemical conversion coating.

Further, Patent Literature 5 describes a method in which the steel sheet temperature is brought to 350 to 650° C. in an oxidative atmosphere so as to form an oxide film on the surface of the steel sheet, and thereafter the steel sheet is heated to a recrystallization temperature in a reductive atmosphere and subsequently cooled. With this method, however, the thickness of the oxide film formed on the surface of the steel sheet is variable depending on the oxidation method. That is, the oxidation does not take place sufficiently or the oxide film becomes excessively thick with the result that the oxide film leaves residue or is exfoliated during the subsequent annealing in a reductive atmosphere, possibly resulting in a deterioration in surface quality. In EXAMPLES, this Patent Literature describes an embodiment in which oxidation is carried out in air. However, oxidation in air gives a thick oxide which is hardly reduced in subsequent reduction or requires a reductive atmosphere with a high hydrogen concentration.

Furthermore, Patent Literature 6 describes a method in which a cold rolled steel sheet containing, in terms of mass %, Si at not less than 0.1% and/or Mn at not less than 1.0% is heated at a steel sheet temperature of not less than 400° C. in an iron-oxidizing atmosphere to form an oxide film on the surface of the steel sheet, and thereafter the oxide film on the surface of the steel sheet is reduced in an iron-reducing atmosphere. In detail, iron on the surface of the steel sheet is oxidized at not less than 400° C. using a direct flame burner with an air ratio of not less than 0.93 and not more than 1.10, and thereafter the steel sheet is annealed in a $N_2$+$H_2$ gas atmosphere which reduces the iron oxide, thereby forming reduced Fe layer on the outermost surface while suppressing the oxidation of $SiO_2$ which lowers phosphatability from occurring on the outermost surface. Patent Literature 6 does not specifically describe the heating temperature with the direct flame burner. However, in the case where Si is present at a high content (generally, 0.6% or more), the oxidation amount of silicon, which is more easily oxidized than iron, becomes large so as to suppress the oxidation of Fe or limit the oxidation of Fe itself to an excessively low level. As a result, the formation of a superficial reduced Fe layer by the reduction becomes insufficient and $SiO_2$ comes to be present on the surface of the steel sheet after the reduction, thus possibly resulting in a region which may not be covered with a chemical film.

PATENT LITERATURE

[PTL 1] Japanese Unexamined Patent Application Publication No. 5-320952

[PTL 2] Japanese Unexamined Patent Application Publication No. 2004-323969

[PTL 3] Japanese Unexamined Patent Application Publication No. 6-10096

[PTL 4] Japanese Unexamined Patent Application Publication No. 2003-113441

[PTL 5] Japanese Unexamined Patent Application Publication No. 55-145122

[PTL 6] Japanese Unexamined Patent Application Publication No. 2006-45615

SUMMARY OF THE INVENTION

The present invention has been made in view of the circumstances described above. The invention provides a high strength steel sheet which exhibits excellent phosphatability and corrosion resistance after electro-coating even in the case of a high Si content, as well as to provide a method for manufacturing such steel sheets.

Actively producing internal oxides has been a conventional approach to improve phosphatability of a steel sheet. However, corrosion resistance after electro-coating is deteriorated at the same time. Thus, the present inventors studied a novel approach based on an unconventional idea capable of solving the above problems. As a result, the present inventors have found that the formation of an internal oxide in a surface portion of a steel sheet can be suppressed by appropriately controlling the atmosphere and the temperature during an annealing step, and thereby excellent phosphatability and higher corrosion resistance are obtained. In detail, a conversion treatment is carried out after a steel sheet is annealed in such a manner that the dew point of the atmosphere is controlled to become not more than −45° C. during the course of soaking when the annealing furnace inside temperature is in the range of not less than 820° C. and not more than 1000° C. as well as that the dew point of the atmosphere is controlled to become not more than −45° C. during the course of cooling when the annealing furnace inside temperature is in the range of not less than 750° C. By this treatment, the reducing ability in the atmosphere is increased to make it possible to reduce oxides of easily oxidized elements such as Si and Mn that have been formed on the steel sheet surface by selective surface oxidation (hereinafter, referred to as surface segregation).

Heretofore no attempts have been made to perform a conversion treatment for a high strength steel sheet containing Si and Mn after annealing the steel sheet in an atmosphere having a dew point of not more than −45° C. The reason for this is because it has been a technical common knowledge that the selective oxidation of Si and Mn in a furnace cannot be prevented as long as the atmosphere has an industrially feasible dew point. According to Literature 1 (7th International Conference on Zinc and Zinc Alloy Coated Steel Sheet, Galvatech 2007, Proceedings p. 404), the oxygen potential is converted into a dew point based on thermodynamic data of oxidation reactions of Si and Mn. This Literature then indicates that oxidation cannot be prevented and oxides once formed cannot be reduced unless the dew point is controlled to be less than −80° C. for Si and less than −60° C. for Mn at 800° C. in the presence of $N_2$−10% $H_2$. Thus, it has been considered that, even if the hydrogen concentration is increased, surface segregation cannot be prevented when a high strength steel sheet containing Si and Mn is annealed unless the dew point is controlled to be at least less than −80° C. Therefore, no attempts have been made in which a conversion treatment is performed after annealing is carried out in an atmosphere having a dew point of −45 to −80° C. However, the present inventors dared to study the possibility of such a conversion treatment and have completed the present invention.

The dew point of the annealing atmosphere for a steel sheet is usually higher than −40° C. Thus, water in the annealing atmosphere needs to be removed in order to control the dew point to be −45° C. or below. Enormous facility costs and operation costs are incurred in order to control the atmosphere in the entirety of an annealing furnace such that the dew point becomes −45° C. In contrast, according to the present invention, the dew point of the atmosphere is preferably controlled to become not more than −45° C. when the annealing furnace inside temperature is in the range of not less than 820° C. and not more than 1000° C. during the course of soaking as well as when the annealing furnace inside temperature is in the range of not less than 750° C. during the course of cooling. Desired properties are obtained by the above controlling, and therefore facility costs and operation costs are saved.

The oxygen potential in the atmosphere is so low that internal oxidation does not substantially take place. By controlling the dew point of the atmosphere in the above manner, the formation of internal oxides does not take place and surface oxides are reduced with the result that high strength steel sheets are obtained which exhibit excellent phosphatability to prevent the occurrence of non-covered regions or uneven results of conversion treatment as well as excellent corrosion resistance after electro-coating. The term "excellent phosphatability" means that a steel sheet having undergone a conversion treatment has an appearance without any non-covered regions or uneven results of the conversion treatment.

Except when the temperature is in the range in which the dew point should be controlled to become not more than −45° C., the dew point may be higher than −45° C., and may be a usual dew point in the range of above −40° C. to −10° C.

In a high strength steel sheet obtained in the above manner, an oxide of one or more selected from Fe, Si, Mn, Al and P, as well as from B, Nb, Ti, Cr, Mo, Cu and Ni has been suppressed from being formed in a surface portion of the steel sheet extending from the steel sheet surface within a depth of 100 μm, and the total amount of such oxides formed is limited to not more than 0.060 g/$m^2$ per single side surface. As a result, the steel sheet exhibits excellent phosphatability and is markedly improved in corrosion resistance after electro-coating.

The present invention is based on the aforementioned findings. Features of embodiments of the invention are as described below.

[1] A method for manufacturing high strength steel sheets, including continuous annealing of a steel sheet which includes, in terms of mass %, C at 0.01 to 0.180, Si at 0.4 to 2.0%, Mn at 1.0 to 3.0%, Al at 0.001 to 1.0%, P at 0.005 to 0.060% and S at ≤0.01%, the balance being represented by Fe and inevitable impurities, in such a manner that the dew point of the atmosphere is controlled to become not more than −45° C. during the course of soaking when the annealing furnace inside temperature is in the range of not less than 820° C. and not more than 1000° C. as well as that the dew point of the atmosphere is controlled to become not more than −45° C. during the course of cooling when the annealing furnace inside temperature is in the range of not less than 750° C.

[2] The method for manufacturing high strength steel sheets described in [1], wherein the chemical composition of the steel sheet further includes one or more elements selected from B at 0.001 to 0.005%, Nb at 0.005 to 0.05%, Ti at 0.005 to 0.05%, Cr at 0.001 to 1.0%, Mo at 0.05 to 1.0%, Cu at 0.05 to 1.0% and Ni at 0.05 to 1.0% in terms of mass %.

[3] The method for manufacturing high strength steel sheets described in [1] or [2], further including, after the continuous annealing, electrolytically pickling the steel sheet in an aqueous solution containing sulfuric acid.

[4] A high strength steel sheet manufactured by the method described in any of [1] to [3] in which a surface portion of the steel sheet extending from the steel sheet surface within a depth of 100 μm contains an oxide of one or more selected from Fe, Si, Mn, Al, P, B, Nb, Ti, Cr, Mo, Cu and Ni at a rate of not more than 0.060 g/m$^2$ per single side surface.

In the present invention, the term "high strength" means that the tensile strength TS is not less than 340 MPa. The high strength steel sheets in the invention include both cold rolled steel sheets and hot rolled steel sheets.

According to the present invention, a high strength steel sheet is obtained which exhibits excellent phosphatability and corrosion resistance after electro-coating even in the case where the steel sheet has a high Si content.

DESCRIPTION OF PREFERRED EMBODIMENTS OF THE INVENTION

The present invention according to exemplary embodiments will be described in detail hereinbelow. In the following description, the unit for the contents of individual elements in the chemical composition of steel is "mass %" and is indicated simply as "%" unless otherwise mentioned.

First, there will be described annealing atmosphere conditions that are the most important requirement in the invention and determine the structure of the surface of the steel sheet.

In a high strength steel sheet containing large amounts of Si and Mn, internal oxidation of the surface of the steel sheet can be an origin of corrosion and therefore needs to be prevented as much as possible in order to achieve satisfactory corrosion resistance.

Promoting the internal oxidation of Si and Mn can improve phosphatability. However, it also leads to a decrease in corrosion resistance. Thus, it is necessary that corrosion resistance be improved by suppressing internal oxidation while good phosphatability be ensured by an approach other than promoting the internal oxidation of Si and Mn. As a result of studies, the present invention provides first that in order to ensure phosphatability, oxides of such elements as Si and Mn that have been formed by surface segregation during the course of heating in annealing are reduced during the course of soaking at a relatively high temperature, and the oxygen potential at an early stage of cooling is lowered to prevent the occurrence of oxidation, thereby decreasing the amounts of oxides on the steel sheet surface and improving phosphatability. Further, internal oxidation is substantially suppressed from occurring in the surface portion of the steel sheet with the result that corrosion resistance is improved.

These effects are obtained by performing annealing in a continuous annealing facility in such a manner that the dew point of the atmosphere is controlled to become not more than −45° C. during the course of soaking when the annealing furnace inside temperature is in the range of not less than 820° C. and not more than 1000° C. as well as that the dew point of the atmosphere is controlled to become not more than −45° C. during the course of cooling when the annealing furnace inside temperature is in the range of not less than 750° C. By controlling the dew point in this manner, surface oxides formed during the course of heating are reduced and the amounts of oxides on the steel sheet surface and decreased. Because the oxygen potential in the annealing atmosphere is low, internal oxides are not substantially formed. As a result, excellent phosphatability to prevent the occurrence of non-covered regions or uneven results of conversion treatment, as well as higher corrosion resistance are obtained.

The annealing furnace inside temperature of interest during the course of soaking is limited to be in the range of not less than 820° C. and not more than 1000° C. for the following reasons. If the temperature is less than 820° C., surface oxides of elements such as Si and Mn cannot be reduced sufficiently even if the reducing ability is increased by lowering the dew point to not more than −45° C. Further, the temperature is limited to be not more than 1000° C. because any temperature higher than 1000° C. is disadvantageous because the equipment (such as rolls) in the annealing furnace is degraded and costs are increased.

The range of the annealing furnace inside temperature in which the dew point is controlled during the course of cooling is limited to be not less than 750° C. for the following reasons. When the temperature is in the range of not less than 750° C., components in the steel start to undergo surface segregation. If the dew point of the atmosphere is not controlled to become not more than −45° C. when the temperature is in this range, steel components are allowed to undergo surface segregation. Such surface segregation can be suppressed by controlling the dew point of the atmosphere to become not more than −45° C. If the temperature is less than 750° C., surface oxides cannot be reduced at such a low temperature even if the dew point of the atmosphere is lowered. Thus, the range of the annealing furnace inside temperature (in which the dew point is to be controlled) during the course of cooling is limited to be not less than 750° C.

Next, the chemical composition of the high strength steel sheets of interest according to embodiments of the present invention will be described.

C: 0.01 to 0.18%

Carbon increases workability by forming phases such as martensite in the steel microstructure. In order to obtain this effect, carbon needs to be added at not less than 0.01%. On the other hand, adding carbon in excess of 0.18% causes a decrease in ductility as well as deteriorations in quality and weldability. Thus, the C content is limited to be not less than 0.01% and not more than 0.18%.

Si: 0.4 to 2.0%

Silicon increases the strength and the ductility of steel and is therefore an effective element for achieving a good quality. In order to obtain the objective strength in the present invention, silicon is advantageously added at not less than 0.4%. Steel sheets having a Si content of less than 0.4% cannot achieve a preferred strength of interest in the invention and are substantially free of problems in terms of phosphatability. On the other hand, adding silicon in excess of 2.0% results in the saturation of steel strengthening effects as well as the saturation of ductility enhancement. Further, achieving an improvement of phosphatability becomes difficult. Thus, the Si content is limited to be not less than 0.4% and not more than 2.0%.

Mn: 1.0 to 3.0%

Manganese is an effective element for increasing the strength of steel. In order to ensure mechanical characteristics and strength, the Mn content needs to be not less than 1.0%. On the other hand, adding manganese in excess of 3.0% causes difficulties in ensuring weldability as well as in ensuring the balance between strength and elongation. Thus, the Mn content is limited to be not less than 1.0% and not more than 3.0%.

Al: 0.001 to 1.0%

Aluminum is added for the purpose of deoxidizing molten steel. This purpose is not fulfilled if the Al content is less than 0.001%. The deoxidizing effect for molten steel is obtained by adding aluminum at not less than 0.001%. On the other hand, adding aluminum in excess of 1.0% increases costs and results in an increase in the amount of surface segregation of aluminum, thereby making it difficult to improve phosphatability. Thus, the Al content is limited to be not less than 0.001% and not more than 1.0%.

P: 0.005 to not more than 0.060%

Phosphorus is one of elements that are inevitably present in steel. An increase in cost is expected if the P content is reduced to below 0.005%. Thus, the P content is specified to be not less than 0.005%. On the other hand, any P content exceeding 0.060% leads to a decrease in weldability and causes a marked deterioration in phosphatability to such an extent that it becomes difficult to improve phosphatability even by the present invention. Thus, the P content is limited to be not less than 0.005% and not more than 0.060%.

S: ≤0.01%

Sulfur is one of inevitable elements. The lower limit is not particularly limited. However, the presence of this element in a large amount causes decreases in weldability and corrosion resistance. Thus, the S content is limited to be not more than 0.01%.

In order to control the balance between strength and elongation, one or more elements selected from 0.001 to 0.005% of B, 0.005 to 0.05% of Nb, 0.005 to 0.05% of Ti, 0.001 to 1.0% of Cr, 0.05 to 1.0% of Mo, 0.05 to 1.0% of Cu and 0.05 to 1.0% of Ni may be added as required.

The appropriate amounts of these optional elements are limited for the following reasons.

B: 0.001 to 0.005%

The effect in promoting hardening is hardly obtained if the B content is less than 0.001%. On the other hand, adding boron in excess of 0.005% results in a decrease in phosphatability. Thus, when boron is added, the B content is limited to be not less than 0.001% and not more than 0.005%. However, it is needless to mention that boron may not be added when the addition of this element is considered to be unnecessary in view of an improvement in mechanical characteristics.

Nb: 0.005 to 0.05%

The effect in adjusting strength is hardly obtained if the Nb content is less than 0.005%. On the other hand, adding niobium in excess of 0.05% results in an increase in cost. Thus, when niobium is added, the Nb content is limited to be not less than 0.005% and not more than 0.05%.

Ti: 0.005 to 0.05%

The effect in adjusting strength is hardly obtained if the Ti content is less than 0.005%. On the other hand, adding titanium in excess of 0.05% results in a decrease in phosphatability. Thus, when titanium is added, the Ti content is limited to be not less than 0.005% and not more than 0.05%.

Cr: 0.001 to 1.0%

The effect in promoting hardening is hardly obtained if the Cr content is less than 0.001%. On the other hand, adding chromium in excess of 1.0% results in the surface segregation of chromium and a consequent decrease in weldability. Thus, when chromium is added, the Cr content is limited to be not less than 0.001% and not more than 1.0%.

Mo: 0.05 to 1.0%

The effect in adjusting strength is hardly obtained if the Mo content is less than 0.05%. On the other hand, adding molybdenum in excess of 1.0% results in an increase in cost. Thus, when molybdenum is added, the Mo content is limited to be not less than 0.05% and not more than 1.0%.

Cu: 0.05 to 1.0%

The effect in promoting the formation of a retained γ-phase is hardly obtained if the Cu content is less than 0.05%. On the other hand, adding copper in excess of 1.0% results in an increase in cost. Thus, when copper is added, the Cu content is limited to be not less than 0.05% and not more than 1.0%.

Ni: 0.05 to 1.0%

The effect in promoting the formation of a retained γ-phase is hardly obtained if the Ni content is less than 0.05%. On the other hand, adding nickel in excess of 1.0% results in an increase in cost. Thus, when nickel is added, the Ni content is limited to be not less than 0.05% and not more than 1.0%.

The balance after the deduction of the aforementioned elements is represented by Fe and inevitable impurities.

Next, there will be described a method for manufacturing the high strength steel sheets according to embodiments of the invention as well as the reasons why the conditions in the method are limited.

In an embodiment, a steel having the above-described chemical composition is hot rolled and is thereafter cold rolled to give a steel sheet, and subsequently the steel sheet is annealed in a continuous annealing facility. In the present invention, the annealing is carried out in such a manner that the dew point of the atmosphere is preferably controlled to become not more than −45° C. during the course of soaking when the annealing furnace inside temperature is in the range of not less than 820° C. and not more than 1000° C. as well as that the dew point of the atmosphere is controlled to become not more than −45° C. during the course of cooling when the annealing furnace inside temperature is in the range of not less than 750° C. In the above processing of steel, it is possible to anneal the hot rolled steel sheet without subjecting it to cold rolling.

Hot Rolling

Hot rolling may be performed under usual conditions.

Pickling

It is preferable to perform a pickling treatment after hot rolling. In the pickling step, black scales formed on the surface are removed and the steel sheet is subjected to cold rolling. Pickling conditions are not particularly limited.

Cold Rolling

Cold rolling is preferably carried out with a draft of not less than 40% and not more than 80%. If the draft is less than 40%, the recrystallization temperature becomes lower and the steel sheet tends to be deteriorated in mechanical characteristics. On the other hand, because the steel sheet of the invention is a high strength steel sheet, cold rolling the steel sheet with a draft exceeding 80% increases not only the rolling costs but also the amount of surface segregation during annealing, possibly resulting in a decrease in phosphatability.

The steel sheet that has been cold rolled or hot rolled is annealed and then subjected to a conversion treatment.

In an annealing furnace, the steel sheet undergoes a heating step in which the steel sheet is heated to a predetermined temperature in an upstream heating zone, a soaking step in which the steel sheet is held in a downstream soaking zone at a predetermined temperature for a prescribed time, and a cooling step.

As described above, the annealing is performed in such a manner that the dew point of the atmosphere is controlled to become not more than −45° C. during the course of soaking when the annealing furnace inside temperature is in the range of not less than 820° C. and not more than 1000° C. as well as that the dew point of the atmosphere is controlled to become not more than −45° C. during the course of cooling when the annealing furnace inside temperature is in the range of not less than 750° C. The thus-annealed steel sheet is thereafter subjected to a conversion treatment. Because the dew point of the atmosphere is usually higher than −40° C., the dew point is controlled to become not more than −45° C. by absorbing and removing water in the furnace with a water absorber.

If the volume fraction of hydrogen gas in the atmosphere is less than 1 vol %, the activation effect by reduction cannot be obtained and phosphatability is deteriorated. Although the upper limit is not particularly limited, costs are increased and the effect is saturated if the fraction exceeds 50 vol %. Thus, the volume fraction of hydrogen gas is preferably not less than 1 vol % and not more than 50 vol %. The gas components in the annealing furnace except hydrogen gas are nitrogen gas and inevitable impurity gases. Other gas components may be present as long as they are not detrimental in achieving the advantageous effects of the invention.

After the steel sheet is cooled from the temperature range of not less than 820° C. and not more than 1000° C., hardening and tempering may be performed as required. Although the conditions for these treatments are not particularly limited, it is desirable that tempering be performed at a temperature of 150 to 400° C. The reasons are because ductility tends to be lowered if the temperature is less than 150° C. as well as because hardness tends to be decreased if the temperature is in excess of 400° C.

According to the present invention, good phosphatability can be ensured even without performing electrolytic pickling. However, it is preferable that electrolytic pickling be performed in order to remove trace amounts of oxides that have been inevitably generated by surface segregation during annealing and thereby to ensure better phosphatability.

The electrolytic pickling conditions are not particularly limited. However, in order to efficiently remove the inevitably formed surface oxides of silicon and manganese after the annealing, alternating electrolysis at a current density of not less than 1 A/dm$^2$ is desirable. The reasons why alternating electrolysis is selected are because the pickling effects are low if the steel sheet is fixed to a cathode as well as because if the steel sheet is fixed to an anode, iron that is dissolved during electrolysis is accumulated in the pickling solution and the Fe concentration in the pickling solution is increased with the result that the attachment of iron to the surface of the steel sheet causes problems such as dry contamination.

The pickling solution used in the electrolytic pickling is not particularly limited. However, nitric acid or hydrofluoric acid is not preferable because they are highly corrosive to a facility and require careful handling. Hydrochloric acid is not preferable because chlorine gas can be generated from the cathode. In view of corrosiveness and environment, the use of sulfuric acid is preferable. The sulfuric acid concentration is preferably not less than 5 mass % and not more than 20 mass %. If the sulfuric acid concentration is less than 5 mass %, the conductivity is so lowered that the bath voltage is raised during electrolysis possibly to increase the power load. On the other hand, any sulfuric acid concentration exceeding 20 mass % leads to a cost problem because a large loss is caused due to drag-out.

The temperature of the electrolytic solution is preferably not less than 40° C. and not more than 70° C. Because the bath temperature is raised by the generation of heat by continuous electrolysis, the pickling effect may be low if the temperature is less than 40° C. Further, maintaining the temperature below 40° C. is sometimes difficult. Furthermore, a temperature exceeding 70° C. is not preferable in view of the durability of the lining of the electrolytic cell.

The high strength steel sheets of embodiments of the present invention are obtained in the above manner.

As a result, the inventive steel sheet according to exemplary embodiments of the invention has a characteristic structure of the surface described below.

An oxide of one or more selected from Fe, Si, Mn, Al and P, as well as from B, Nb, Ti, Cr, Mo, Cu and Ni has been suppressed from being formed in a surface portion of the steel sheet extending from the steel sheet surface within a depth of 100 μm, and the total amount of such oxides formed is limited to not more than 0.060 g/m$^2$ per single side surface.

In a high strength steel sheet containing Si and a large amount of Mn, internal oxidation of the surface of the steel sheet can be an origin of corrosion and therefore needs to be prevented as much as possible in order to achieve satisfactory corrosion resistance.

Thus, the present invention first provides that in order to ensure phosphatability, the oxygen potential in the annealing step is lowered and thereby the activities of easily oxidized elements such as Si and Mn in the surface portion of base iron are lowered. In this manner, the external oxidation of these elements is suppressed and consequently phosphatability is improved. Further, internal oxidation is also suppressed from occurring in the surface portion of the steel sheet with the result that corrosion resistance is improved. These effects become apparent by preventing the surface portion of the steel sheet which extends from the surface of the base steel sheet within a depth of 100 μm from the formation of an oxide of one or more selected from Fe, Si, Mn, Al and P, as well as from B, Nb, Ti, Cr, Mo, Cu and Ni such that the total amount of such oxides formed is not more than 0.060 g/m$^2$. If the total amount of formed oxides (hereinafter, referred to as "internal oxidation amount") is in excess of 0.060 g/m$^2$, corrosion resistance is deteriorated. The effect in the improvement of corrosion resistance is saturated even when the internal oxidation amount is reduced to less than 0.0001 g/m$^2$. Thus, the lower limit of the internal oxidation amount is preferably 0.0001 g/m$^2$.

EXAMPLE 1

Hereinbelow, embodiments of the present invention will be described in detail based on EXAMPLES.

Hot rolled steel sheets with a steel composition described in Table 1 were pickled to remove black scales and were thereafter cold rolled to give cold rolled steel sheets with a thickness of 1.0 mm. Cold rolling was omitted for some of the steel sheets. That is, as-descaled hot rolled steel sheets (thickness: 2.0 mm) were also provided.

TABLE 1

| Steel code | C | Si | Mn | Al | P | S | Cr | Mo | B | Nb | Cu | Ni | (mass %) Ti |
|---|---|---|---|---|---|---|---|---|---|---|---|---|---|
| A | 0.04 | 0.1 | 1.9 | 0.04 | 0.01 | 0.003 | — | — | — | — | — | — | — |
| B | 0.03 | 0.4 | 2.0 | 0.04 | 0.01 | 0.003 | — | — | — | — | — | — | — |
| C | 0.09 | 0.9 | 2.1 | 0.03 | 0.01 | 0.004 | — | — | — | — | — | — | — |
| D | 0.13 | 1.3 | 2.0 | 0.03 | 0.01 | 0.003 | — | — | — | — | — | — | — |
| E | 0.09 | 1.7 | 1.9 | 0.03 | 0.01 | 0.003 | — | — | — | — | — | — | — |
| F | 0.08 | 2.0 | 2.1 | 0.03 | 0.01 | 0.003 | — | — | — | — | — | — | — |
| G | 0.11 | 1.3 | 2.8 | 0.04 | 0.01 | 0.003 | — | — | — | — | — | — | — |
| H | 0.12 | 1.3 | 2.0 | 0.95 | 0.01 | 0.003 | — | — | — | — | — | — | — |
| I | 0.12 | 1.3 | 2.0 | 0.04 | 0.06 | 0.004 | — | — | — | — | — | — | — |
| J | 0.12 | 1.3 | 2.1 | 0.03 | 0.01 | 0.008 | — | — | — | — | — | — | — |
| K | 0.12 | 1.3 | 1.9 | 0.02 | 0.01 | 0.003 | 0.7 | — | — | — | — | — | — |
| L | 0.12 | 1.3 | 2.0 | 0.04 | 0.01 | 0.003 | — | 0.12 | — | — | — | — | — |
| M | 0.12 | 1.3 | 2.1 | 0.03 | 0.01 | 0.003 | — | — | 0.005 | — | — | — | — |
| N | 0.12 | 1.3 | 2.0 | 0.05 | 0.01 | 0.003 | — | — | 0.001 | 0.04 | — | — | — |
| O | 0.12 | 1.3 | 1.9 | 0.03 | 0.01 | 0.004 | — | 0.11 | — | — | 0.2 | 0.3 | — |
| P | 0.12 | 1.3 | 1.9 | 0.04 | 0.01 | 0.003 | — | — | 0.003 | — | — | — | 0.03 |
| Q | 0.12 | 1.3 | 2.0 | 0.03 | 0.01 | 0.004 | — | — | — | — | — | — | 0.05 |
| R | 0.20 | 1.3 | 2.1 | 0.04 | 0.01 | 0.003 | — | — | — | — | — | — | — |
| S | 0.12 | 2.1 | 1.9 | 0.04 | 0.01 | 0.003 | — | — | — | — | — | — | — |
| T | 0.12 | 1.3 | 3.1 | 0.04 | 0.01 | 0.004 | — | — | — | — | — | — | — |
| U | 0.12 | 1.3 | 2.0 | 1.10 | 0.01 | 0.004 | — | — | — | — | — | — | — |
| V | 0.12 | 1.3 | 1.9 | 0.03 | 0.07 | 0.003 | — | — | — | — | — | — | — |
| W | 0.12 | 1.3 | 2.1 | 0.04 | 0.01 | 0.015 | — | — | — | — | — | — | — |

Underlines indicate "outside the inventive range".

Next, the cold rolled steel sheets and the hot rolled steel sheets were introduced into a continuous annealing facility. The steel sheet was passed through the annealing facility while the dew point was controlled as described in Table 2 when the annealing furnace inside temperature was in the range of not less than 820° C. and not more than 1000° C. during the course of soaking as well as when the annealing furnace inside temperature was in the range of not less than 750° C. during the course of cooling. The annealed steel sheet was thereafter subjected to water hardening and then to tempering at 300° C. for 140 seconds. Subsequently, electrolytic pickling was performed by alternating electrolysis in a 5 mass aqueous sulfuric acid solution at 40° C. under current density conditions described in Table 2 while switching the polarity of the sample sheet between anodic and cathodic alternately each after 3 seconds. Thus, sample sheets were prepared. The dew point in the annealing furnace was basically set at −35° C. except when the dew point was controlled in accordance with the furnace temperature. The gas components in the atmosphere included nitrogen gas, hydrogen gas and inevitable impurity gases. The dew point was controlled by removing water in the atmosphere by absorption. The hydrogen concentration in the atmosphere was basically set at 10 vol %.

With respect to the obtained sample sheets, TS and El were measured in accordance with a tensile testing method for metallic materials described in JIS Z 2241. Further, the sample sheets were tested to examine phosphatability and corrosion resistance, as well as the amount of oxides present in a surface portion of the steel sheet extending immediately from the surface of the steel sheet to a depth of 100 μm (the internal oxidation amount). The measurement methods and the evaluation criteria are described below.

Phosphatability

Phosphatability was evaluated by the following method.

A conversion treatment liquid (PALBOND L3080 (registered trademark)) manufactured by Nihon Parkerizing Co., Ltd. was used. A conversion treatment was carried out in the following manner.

The sample sheet was degreased with degreasing liquid FINE CLEANER (registered trademark) manufactured by Nihon Parkerizing Co., Ltd., and was thereafter washed with water. Subsequently, the surface of the sample sheet was conditioned for 30 seconds with surface conditioning liquid PREPAREN Z (registered trademark) manufactured by Nihon Parkerizing Co., Ltd. The sample sheet was then soaked in the conversion treatment liquid (PALBOND L3080) at 43° C. for 120 seconds, washed with water and dried with hot air.

The sample sheet after the conversion treatment was observed with a scanning electron microscope (SEM) at 500× magnification with respect to randomly selected five fields of view. The area ratio of the regions that had not been covered with the chemical conversion coating was measured by image processing. Phosphatability was evaluated based on the area ratio of the non-covered regions according to the following criteria. The symbol ○ indicates an acceptable level.

○: not more than 10% x: more than 10%

Corrosion Resistance after Electro-Coating

A 70 mm×150 mm test piece was cut out from the sample sheet that had been subjected to the above conversion treatment. The test piece was cationically electro-coated with PN-150G (registered trademark) manufactured by NIPPON PAINT Co., Ltd. (baking conditions: 170° C.×20 min, film thickness: 25 μm). Thereafter, the edges and the non-test surface were sealed with an Al tape, and the test surface was cut deep into the base steel with a cutter knife to create a cross cut pattern (cross angle: 60°), thereby preparing a sample.

Next, the sample was soaked in a 5% aqueous NaCl solution (55° C.) for 240 hours, removed from the solution, washed with water and dried. Thereafter, an adhesive tape was applied to the cross cut pattern and was peeled therefrom. The exfoliation width was measured and was evaluated based on the following criteria. The symbol ○ indicates an acceptable level.

○: The exfoliation width on one surface was less than 2.5 mm.

x: The exfoliation width on one surface was 2.5 mm or more.

Workability

To evaluate workability, a JIS No. 5 tensile test piece was sampled from the sample sheet in a direction that was 90° relative to the rolling direction. The test piece was subjected to a tensile test at a constant cross head speed of 10 mm/min in accordance with JIS Z 2241, thereby determining the tensile strength (TS/MPa) and the ductility (El %). For steel sheets with TS of less than 650 MPa, workability was evaluated to be good when TS×El≥22,000 and to be bad when TS×El<22,000. For steel sheets with TS of 650 MPa to 900 MPa, workability was evaluated to be good when TS×El≥20,000 and to be bad when TS×El<20,000. For steel sheets with TS of not less than 900 MPa, workability was evaluated to be good when TS×El≥18,000 and to be bad when TS×El<18,000.

The internal oxidation amount, namely, the amount of internal oxidation from the steel sheet surface to a depth of 100 μm was measured by an "impulse furnace fusion-infrared absorption method". It should be noted that the amount of oxygen present in the starting material (namely, the high strength steel sheet before annealing) should be subtracted. Thus, in one embodiment of the invention, surface portions on both sides of the continuously annealed high strength steel sheet were polished by at least 100 μm and thereafter the oxygen concentration in the steel was measured. The measured value was obtained as the oxygen amount OH of the starting material. Further, the oxygen concentration was measured across the entirety of the continuously annealed high strength steel sheet in the sheet thickness direction. The measured value was obtained as the oxygen amount OI after internal oxidation. The difference between OI and OH (=OI−OH) was calculated wherein OI was the oxygen amount in the high strength steel sheet after internal oxidation and OH was the oxygen amount in the starting material. The difference was then converted to an amount per unit area (namely, 1 $m^2$) on one surface, thereby determining the internal oxidation amount ($g/m^2$).

The results and the manufacturing conditions are described in Table 2.

TABLE 2

| | Steel | | | Annealing furnace | | | | | | |
|---|---|---|---|---|---|---|---|---|---|---|
| No. | Steel code | Si (mass %) | Mn (mass %) | Dew-point (° C.) at below 820° C. | Dew-point (° C.) at 820° C. and above | Dew-point (° C.) at 750° C. and above in cooling zone | Soaking temp. (° C.) | Internal oxidation amount ($g/m^2$) | Electrolytic pickling | Current density $A/dm^2$ |
| 1 | D | 1.3 | 2.0 | −35 | −25 | −50 | 850 | 0.235 | Not performed | — |
| 2 | D | 1.3 | 2.0 | −35 | −35 | −50 | 850 | 0.136 | Not performed | — |
| 3 | D | 1.3 | 2.0 | −35 | −40 | −50 | 850 | 0.076 | Not performed | — |
| 4 | D | 1.3 | 2.0 | −35 | −45 | −50 | 850 | 0.055 | Not performed | — |
| 5 | D | 1.3 | 2.0 | −35 | −50 | −50 | 850 | 0.014 | Not performed | — |
| 6 | D | 1.3 | 2.0 | −35 | −60 | −50 | 850 | 0.009 | Not performed | — |
| 7 | D | 1.3 | 2.0 | −35 | −50 | −25 | 850 | 0.193 | Not performed | — |
| 8 | D | 1.3 | 2.0 | −35 | −50 | −35 | 850 | 0.129 | Not performed | — |
| 9 | D | 1.3 | 2.0 | −35 | −50 | −40 | 850 | 0.069 | Not performed | — |
| 10 | D | 1.3 | 2.0 | −35 | −50 | −45 | 850 | 0.054 | Not performed | — |
| 11 | D | 1.3 | 2.0 | −35 | −50 | −60 | 850 | 0.011 | Not performed | — |
| 12 | D | 1.3 | 2.0 | −35 | −50 | −50 | 750 | 0.005 | Not performed | — |
| 13 | D | 1.3 | 2.0 | −35 | −50 | −50 | 800 | 0.008 | Not performed | — |
| 14 | D | 1.3 | 2.0 | −35 | −50 | −50 | 820 | 0.012 | Not performed | — |
| 15 | D | 1.3 | 2.0 | −35 | −50 | −50 | 900 | 0.026 | Not performed | — |
| 16 | D | 1.3 | 2.0 | −35 | −50 | −50 | 950 | 0.033 | Not performed | — |
| 17 | D | 1.3 | 2.0 | −35 | −50 | −50 | 850 | 0.013 | Performed | 1 |
| 18 | D | 1.3 | 2.0 | −35 | −50 | −50 | 850 | 0.012 | Performed | 5 |
| 19 | D | 1.3 | 2.0 | −35 | −50 | −50 | 850 | 0.012 | Performed | 10 |
| 20 | A | 0.1 | 1.9 | −35 | −50 | −50 | 850 | 0.003 | Not performed | — |
| 21 | B | 0.4 | 2.0 | −35 | −50 | −50 | 850 | 0.006 | Not performed | — |
| 22 | C | 0.9 | 2.1 | −35 | −50 | −50 | 850 | 0.008 | Not performed | — |

TABLE 2-continued

| | | | | | | | | | | |
|---|---|---|---|---|---|---|---|---|---|---|
| 23 | E | 1.7 | 1.9 | −35 | −50 | −50 | 850 | 0.025 | Not performed | — |
| 24 | F | 2.0 | 2.1 | −35 | −50 | −50 | 850 | 0.037 | Not performed | — |
| 25 | G | 1.3 | 2.8 | −35 | −50 | −50 | 850 | 0.016 | Not performed | — |
| 26 | H | 1.3 | 2.0 | −35 | −50 | −50 | 850 | 0.044 | Not performed | — |
| 27 | I | 1.3 | 2.0 | −35 | −50 | −50 | 850 | 0.018 | Not performed | — |
| 28 | J | 1.3 | 2.1 | −35 | −50 | −50 | 850 | 0.012 | Not performed | — |
| 29 | K | 1.3 | 1.9 | −35 | −50 | −50 | 850 | 0.011 | Not performed | — |
| 30 | L | 1.3 | 2.0 | −35 | −50 | −50 | 850 | 0.012 | Not performed | — |
| 31 | M | 1.3 | 2.1 | −35 | −50 | −50 | 850 | 0.013 | Not performed | — |
| 32 | N | 1.3 | 2.0 | −35 | −50 | −50 | 850 | 0.012 | Not performed | — |
| 33 | O | 1.3 | 1.9 | −35 | −50 | −50 | 850 | 0.012 | Not performed | — |
| 34 | P | 1.3 | 1.9 | −35 | −50 | −50 | 850 | 0.011 | Not performed | — |
| 35 | Q | 1.3 | 2.0 | −35 | −50 | −50 | 850 | 0.013 | Not performed | — |
| 36 | R | 1.3 | 2.1 | −35 | −50 | −50 | 850 | 0.012 | Not performed | — |
| 37 | S | 2.1 | 1.9 | −35 | −50 | −50 | 850 | 0.046 | Not performed | — |
| 38 | T | 1.3 | 3.1 | −35 | −50 | −50 | 850 | 0.013 | Not performed | — |
| 39 | U | 1.3 | 2.0 | −35 | −50 | −50 | 850 | 0.041 | Not performed | — |
| 40 | V | 1.3 | 1.9 | −35 | −50 | −50 | 850 | 0.022 | Not performed | — |
| 41 | W | 1.3 | 2.1 | −35 | −50 | −50 | 850 | 0.011 | Not performed | — |

| No. | Phosphatability | Corrosion resistance after electro-coating | TS mpa | El % | TS × El | Workability | Remarks |
|---|---|---|---|---|---|---|---|
| 1 | x | x | 1077 | 19.9 | 21432 | Good | COMP. EX. |
| 2 | x | x | 1033 | 18.2 | 18801 | Good | COMP. EX. |
| 3 | x | ○ | 1041 | 19.1 | 19883 | Good | COMP. EX. |
| 4 | ○ | ○ | 1025 | 19.3 | 19783 | Good | INV. EX. |
| 5 | ○ | ○ | 1038 | 19.6 | 20345 | Good | INV. EX. |
| 6 | ○ | ○ | 1031 | 19.2 | 19795 | Good | INV. EX. |
| 7 | x | x | 1011 | 19.6 | 19816 | Good | COMP. EX. |
| 8 | x | x | 1013 | 19.5 | 19754 | Good | COMP. EX. |
| 9 | x | ○ | 1028 | 18.2 | 18710 | Good | COMP. EX. |
| 10 | ○ | ○ | 1064 | 19.5 | 20748 | Good | INV. EX. |
| 11 | ○ | ○ | 1066 | 19.6 | 20894 | Good | INV. EX. |
| 12 | x | x | 854 | 24.1 | 20581 | Good | COMP. EX. |
| 13 | x | ○ | 974 | 22.5 | 21915 | Good | COMP. EX. |
| 14 | ○ | ○ | 999 | 21.4 | 21379 | Good | INV. EX. |
| 15 | ○ | ○ | 1166 | 19.4 | 22620 | Good | INV. EX. |
| 16 | ○ | ○ | 1195 | 19.5 | 23303 | Good | INV. EX. |
| 17 | ○ | ○ | 1040 | 20.1 | 20904 | Good | INV. EX. |
| 18 | ○ | ○ | 1035 | 20.6 | 21321 | Good | INV. EX. |
| 19 | ○ | ○ | 1041 | 20.5 | 21341 | Good | INV. EX. |

TABLE 2-continued

| | | | | | | | |
|---|---|---|---|---|---|---|---|
| 20 | ○ | ○ | 680 | 28.6 | 19448 | Bad | COMP. EX. |
| 21 | ○ | ○ | 1001 | 20.4 | 20420 | Good | INV. EX. |
| 22 | ○ | ○ | 1022 | 21.4 | 21871 | Good | INV. EX. |
| 23 | ○ | ○ | 1033 | 21.9 | 22623 | Good | NV. EX. |
| 24 | ○ | ○ | 1126 | 18.4 | 20718 | Good | INV. EX. |
| 25 | ○ | ○ | 1064 | 19.6 | 20854 | Good | INV. EX. |
| 26 | ○ | ○ | 1055 | 19.5 | 20573 | Good | INV. EX. |
| 27 | ○ | ○ | 1136 | 18.4 | 20902 | Good | INV. EX. |
| 28 | ○ | ○ | 1032 | 19.5 | 20124 | Good | INV. EX. |
| 29 | ○ | ○ | 1051 | 19.3 | 20284 | Good | INV. EX. |
| 30 | ○ | ○ | 1055 | 19.1 | 20151 | Good | INV. EX. |
| 31 | ○ | ○ | 1025 | 20.1 | 20603 | Good | INV. EX. |
| 32 | ○ | ○ | 1065 | 19.4 | 20661 | Good | INV. EX. |
| 33 | ○ | ○ | 1074 | 19.8 | 21265 | Good | INV. EX. |
| 34 | ○ | ○ | 812 | 25.6 | 20787 | Good | INV. EX. |
| 35 | ○ | ○ | 1045 | 19.5 | 20378 | Good | INV. EX. |
| 36 | ○ | ○ | 1256 | 14.2 | 17835 | Bad | COMP. EX. |
| 37 | x | ○ | 1195 | 16.3 | 19479 | Good | COMP. EX. |
| 38 | ○ | ○ | 1114 | 15.2 | 16933 | Bad | COMP. EX. |
| 39 | x | x | 1065 | 19.3 | 20555 | Good | COMP. EX. |
| 40 | x | ○ | 1122 | 17.5 | 19635 | Good | COMP. EX. |
| 41 | ○ | x | 1074 | 19.2 | 20621 | Good | COMP. EX. |

From Table 2, the high strength steel sheets manufactured by the inventive method were shown to be excellent in phosphatability, corrosion resistance after electro-coating and workability in spite of the fact that these high strength steel sheets contained large amounts of easily oxidized elements such as Si and Mn. On the other hand, the steel sheets obtained in COMPARATIVE EXAMPLES were poor in at least one of phosphatability, corrosion resistance after electro-coating and workability.

INDUSTRIAL APPLICABILITY

The high strength steel sheets according to the present invention are excellent in phosphatability, corrosion resistance and workability, and can be used as surface-treated steel sheets for reducing the weight and increasing the strength of bodies of automobiles. Besides automobiles, the inventive high strength steel sheets can be used as surface-treated steel sheets having a corrosion resistant film on the base steel sheet in a wide range of applications including home appliances and building materials.

The invention claimed is:

1. A method for manufacturing high strength steel sheets, comprising continuous annealing of a steel sheet which includes, in terms of mass %, C at 0.01 to 0.18%, Si at 0.4 to 2.0%, Mn at 1.0 to 3.0%, Al at 0.001 to 1.0%, P at 0.005 to 0.060% and S at ≤0.01%, the balance being represented by Fe and inevitable impurities, in such a manner that a dew point of an atmosphere in an annealing furnace during the continuous annealing is set to be greater than −45° C., except that the dew point of the atmosphere is controlled to be less than or equal to −45° C. during the course of soaking when the annealing furnace inside temperature is in the range of not less than 820° C. and not more than 1000° C. as well as that the dew point of the atmosphere is controlled to be less than or equal to −45° C. during the course of cooling when the annealing furnace inside temperature is in the range of not less than 750° C.

2. The method for manufacturing high strength steel sheets according to claim 1, wherein the chemical composition of the steel sheet further includes one or more elements selected from B at 0.001 to 0.005%, Nb at 0.005 to 0.05%, Ti at 0.005 to 0.05%, Cr at 0.001 to 1.0%, Mo at 0.05 to 1.0%, Cu at 0.05 to 1.0% and Ni at 0.05 to 1.0% in terms of mass %.

3. The method for manufacturing high strength steel sheets according to claim 1, further comprising, after the continuous annealing, electrolytically pickling the steel sheet in an aqueous solution containing sulfuric acid.

4. A high strength steel sheet manufactured by the method described in claim 1 in which a surface portion of the steel sheet extending from the steel sheet surface within a depth of 100 μm contains an oxide of one or more selected from Fe, Si, Mn, Al, P, B, Nb, Ti, Cr, Mo, Cu and Ni at a rate of not more than 0.060 g/m$^2$ per single side surface.

5. The method for manufacturing high strength steel sheets according to claim 2, further comprising, after the continuous annealing, electrolytically pickling the steel sheet in an aqueous solution containing sulfuric acid.

6. The method according to claim 1, wherein the steel sheet has a surface portion extending from the steel sheet surface within a depth of 100 μm containing an oxide of one or more selected from Fe, Si, Mn, Al, P, B, Nb, Ti, Cr, Mo, Cu and Ni at a rate of not more than 0.060 $g/m^2$ per single side surface is manufactured.

7. The method according to claim 1, wherein the dew point of the atmosphere is allowed to be greater than −45° C. during the course of soaking when the annealing furnace inside temperature is in the range of less than 820° C. or more than 1000° C. as well as during the course of cooling when the annealing furnace inside temperature is less than 750° C.

8. The method according to claim 1, wherein the steel sheet includes Si at 1.3 to 2.0%.

9. The method according to claim 1, wherein the dew point of the atmosphere in the annealing furnace is set in the range of from −40° C. to −10° C., except that the dew point of the atmosphere is controlled to be less than or equal to −45° C. during the course of soaking when an annealing furnace inside temperature is in the range of not less than 820° C. and not more than 1000° C. as well as that the dew point of the atmosphere is controlled to be less than or equal to −45° C. during the course of cooling when the annealing furnace inside temperature is in the range of not less than 750° C.

10. The method according to claim 1, wherein the dew point of the atmosphere is controlled to be less than or equal to −45° C. by removing water from said atmosphere in the annealing furnace during the course of soaking when an annealing furnace inside temperature is in the range of not less than 820° C. and not more than 1000° C. as well as that the dew point of the atmosphere is controlled to be less than or equal to −45° C. by removing water from said atmosphere in the annealing furnace during the course of cooling when the annealing furnace inside temperature is in the range of not less than 750° C.

11. The method according to claim 1, wherein the dew point of the atmosphere in the annealing furnace is set in the range of from −35° C. to −10° C., except that the dew point of the atmosphere is controlled to be less than or equal to −45° C. during the course of soaking when an annealing furnace inside temperature is in the range of not less than 820° C. and not more than 1000° C. as well as that the dew point of the atmosphere is controlled to be less than or equal to −45° C. during the course of cooling when the annealing furnace inside temperature is in the range of not less than 750° C.

12. A high strength steel sheet manufactured by the method described in claim 2 in which a surface portion of the steel sheet extending from the steel sheet surface within a depth of 100 μm contains an oxide of one or more selected from Fe, Si, Mn, Al, P, B, Nb, Ti, Cr, Mo, Cu and Ni at a rate of not more than 0.060 $g/m^2$ per single side surface.

* * * * *